United States Patent [19]

Achterwinter et al.

[11] Patent Number: 4,892,264

[45] Date of Patent: Jan. 9, 1990

[54] LOWERING MECHANISM FOR THE FOIL IN A DEVICE FOR WINDING-UP A FOIL WEB, PARTICULARLY A SYNTHETIC-MATERIAL FOIL WEB

[75] Inventors: Norbert Achterwinter, Hilden; Wolfgang Hax, St. Augustin, both of Fed. Rep. of Germany

[73] Assignee: Reifenhauser GmbH & Co. Maschinenfabrik, Troisdorf, Fed. Rep. of Germany

[21] Appl. No.: 215,017

[22] Filed: Jul. 5, 1988

[30] Foreign Application Priority Data

Jul. 3, 1987 [DE] Fed. Rep. of Germany ..... 3721966

[51] Int. Cl.[4] ..... B65H 19/26

[52] U.S. Cl. ..... 242/58.6; 242/65

[58] Field of Search ..... 242/58.6, 56 R, 65, 242/66

[56] References Cited

U.S. PATENT DOCUMENTS 3,592,403 7/1971 Schmidt et al. ..... 242/56 R 3,747,866 7/1973 Schwermann ..... 242/58.6

3,857,524 12/1974 Melead et al. ..... 242/56 R 4,111,377 9/1978 Tetro et al. ..... 242/56 R 4,546,930 10/1985 Rohde et al. ..... 242/56 R

*Primary Examiner*—Stuart S. Levy

*Assistant Examiner*—Steven M. Dubois

*Attorney, Agent, or Firm*—Herbert Dubno

[57] ABSTRACT

Lowering mechanism is disclosed for the foil roll in a device for the winding of a foil web, particularly a synthetic-material foil web. A roll core with the finished foil roll can be received at its ends by lowering arms. It can be deposited on a discharge level by means of a lowering-arm drive. The lowering arms can again be raised with the aid of the lowering-arm drive. For each of the lowering arms, the lowering-arm drive has a lowering cam plate, these being identically built, congruently arranged and provided with an outer leading edge, which is basically shaped as a numeral 6. The lowering arms are guided on the leading edge by means of a guide element. The lowering cam plates are driven by a simple electromotor.

5 Claims, 2 Drawing Sheets

LOWERING MECHANISM FOR THE FOIL IN A DEVICE FOR WINDING-UP A FOIL WEB, PARTICULARLY A SYNTHETIC-MATERIAL FOIL WEB

BACKGROUND OF THE INVENTION

The invention relates to a lowering mechanism for a foil roll in a device for winding up a foil web, particularly a a foil web of synthetic material. According to the invention the foil web is guided between a contact roller and the foil roll fitted with a roll core. The roll core carrying the finished foil roll can be received at its end by lowering arms and deposited on a discharge level by means of a lowering-arm drive. The lowering arms can be raised again with the aid of a lowering-arm drive. This invention relates particularly—but is not limited—to such a device wherein a horizontally running support guide rail is provided, whereupon the ends of the roll core are supported.

In known devices of this kind the lowering arms are equipped with lever arms with cylinder-piston arrangements engaging therewith, thus controlling the lowering motion. They are mostly set in motion via limit switches, which are activated by the roll cores with the wound-up foil roll when these reach the position for lowering. In an arrangement of this type, it has to be accepted that the torque which has to be applied or supported by the cylinder piston arrangement changes with the lowering angle. On the other hand, a relatively high torque which depends on the diameter of the foil roll and under certain circumstances results from tons of weight, has to be absorbed. As a result, the known steps are expensive, particularly from the point of view of driving and control techniques.

It is the object of the invention to simplify, from the point of view of driving and control techniques, the lowering operation of a roll core bearing the finished foil roll in a generic device.

SUMMARY OF THE INVENTION

In order to solve this problem, the invention teaches that the lowering-arm drive for each of the lowering arms has to be provided with a lowering cam plate, these being identically built and congruently arranged and equipped with an outer, basically 6-shaped cam (with the configuration of a plane spiral). Moreover, the lowering arms have to be guided with a guide element, e.g. a guide roller, on the leading edge and that the lowering cam plates have to be driven by an electromotor. It is possible within the frame work of the invention to optimize the arrangement in such a way that the leading edges correspond to an equal-torque cam. This means that the cam is so selected that the torque applied to the lowering cam plate or which has to be absorbed thereby, does not change when the lowering angle is modified. Furthermore, the geometrical proportions can be selected without difficulty to promote a relatively low torque. Particularly then the possibility arises for using a simple three-phase geared motor, which is relatively small, for the drive of the lowering arms. The three-phase geared motor has only to operate movement between the lowering cam plate and the lowering arm, while it is practically unencumbered by the weight of the foil roll. Generally, the lowering cam plates will be installed on a common shaft and the electromotor connected thereto. This drive can be reversed for the lifting motion of the lowering arms. In the embodiment of the invention wherein a horizontally running support guide rail is provided, whereupon the ends of the roll core are supported, the cooperation of the described construction parts with the lowering arms can be achieved in a simple way, due to the fact that the lowering arms, in their receiving position for the roll core with the finished foil roll, reach over the support guide rail with receiving claws and can be set in operation via limit switches.

The achieved advantages are reflected by considerable simplification of the steps to be taken according to the invention for the lowering of the roll core with the wound-up foil roll, namely from the point of view of the driving techniques as well as from the construction. Thereby, the operational safety of the device is generally increased. The steps to be taken according to the invention can be easily incorporated in the normal operation of a device for the winding of a foil web, and particularly of a foil web of synthetic material.

BRIEF DESCRIPTION OF THE DRAWING

Further, the invention is explained in a more detailed manner with the aid of a drawing illustrating only one embodiment example, which shows.

DETAILED DESCRIPTION

Figure 1:
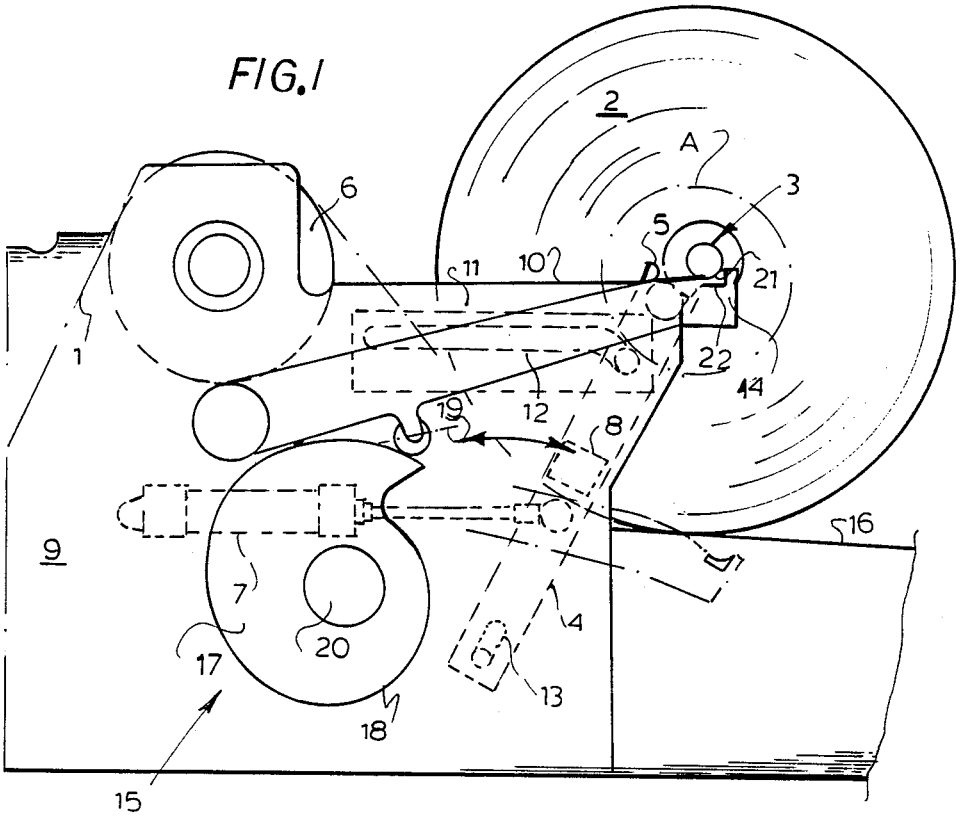
FIG. 1 a lateral view of the device according to the invention.
Figure 2:
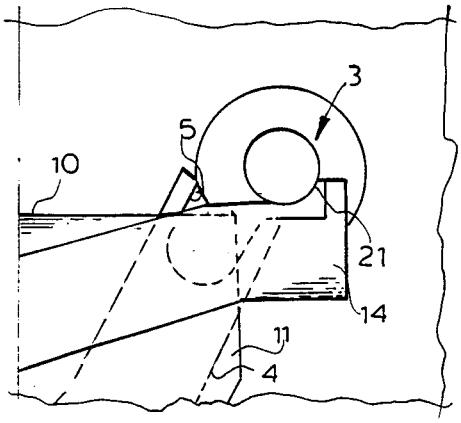
FIG. 2 the detail A of the object according to FIG. 1 with some parts removed, shown on a larger scale than in FIG. 1, and FIG. 3 another embodiment of the object of FIG. 1.

The device shown in the drawing figures serves for the winding of a foil web 1, particularly a synthetic-material foil web into a foil roll 2, taken up upon a roll core 3. Construction of the device requires according to FIG. 1, two swivel arms 4, having at their ends a receiving portion 5 for the roll cores, a contact roller 6 and at least one actuating-cylinder pistons arrangement 7 for the swivel arms 4 and a roll core drive 8, but does not have to be limited to these elements. It is to be understood that the described parts and assemblies are arranged in a corresponding machine frame 9. The arrangement is such that the foil web 1 is guided between contact roller 6 and roll core 3, respectively foil roll 2. Swivel arms 4, at least one of which is provided with the roll core drive 8, can be swung at the size indication of the foil roll 2, whose diameter is increasing. With the actuating-cylinder pistons arrangement 7, a contact pressure is created between contact roller 6 and the roll core 3, resp. foil roll 2, under the interposition of the foil web 1, along the swivel path of the swivel arms 4 indicated by a double arrow. For this purpose, the arrangement is so designed that along the swivel path of each swivel arm 4 is provided a horizontal support guide-rail 10. The ends of the roll core 3 are supported on this rail, of course in such a way that they can be set in rotation, independently of this support system. The described arrangement makes it possible for the swivel arms 4 to act only as a contact-pressure producing device and also to provide it with a corresponding actuating-cylinder pistons assembly 7. This makes possible maintenance of a high-precision constant contact pressure, and if necessary, to set this pressure at very precise values. In the embodiment example and as a preferred embodiment of the invention, the support guide rails 10 are the upper edge of the side walls 11. The side walls 11 contribute to the stability of the machine frame 9. Swivel arms 4 are guided on the one side, namely on the top side, in a coulisse 12 and on the other side, namely at the bottom via the slotted hole 13 and slidably supported therein in such a manner that roller-core receiving portions 5 are guided at the level of the support guide rails 10, when the swivel arms 4 perform their swinging motion. There is also the possibility to build the swivel arms 4 like two-armed levers weight-balanced by counterweights.

In FIG. 1 it can be seen that the roll core 3 with the finished wound-up foil roll 2 can be received at its ends by the lowering arms 14 and discharged by means of a lowering-arm drive 15 to the discharge level 16. The lowering arms 14 can then be raised again by the lowering-arm drive 15. Lowering-arm drive 15 presents for each of the lowering arms 14 a lowering cam plate 17. The lowering cam plates 17 are identically built, congruently arranged and provided with an outer 6-shaped guiding edge 18. Mathematically, the guiding edge 18 follows more or less a plane spiral. Lowering arms 14 are each guided on the assigned guiding edge 18 by means of a guide roller 19. Lowering cam plates 17 are driven by an electromotor not shown in the drawing. Details of the arrangement are such that the leading edges 18 correspond to an equal-torque cam, as explained before. Therefore, the lowering cam plates 17 can be driven by a relatively small three-phase geared motor. In the embodiment example they rest on a common shaft 20.

Figure 3:
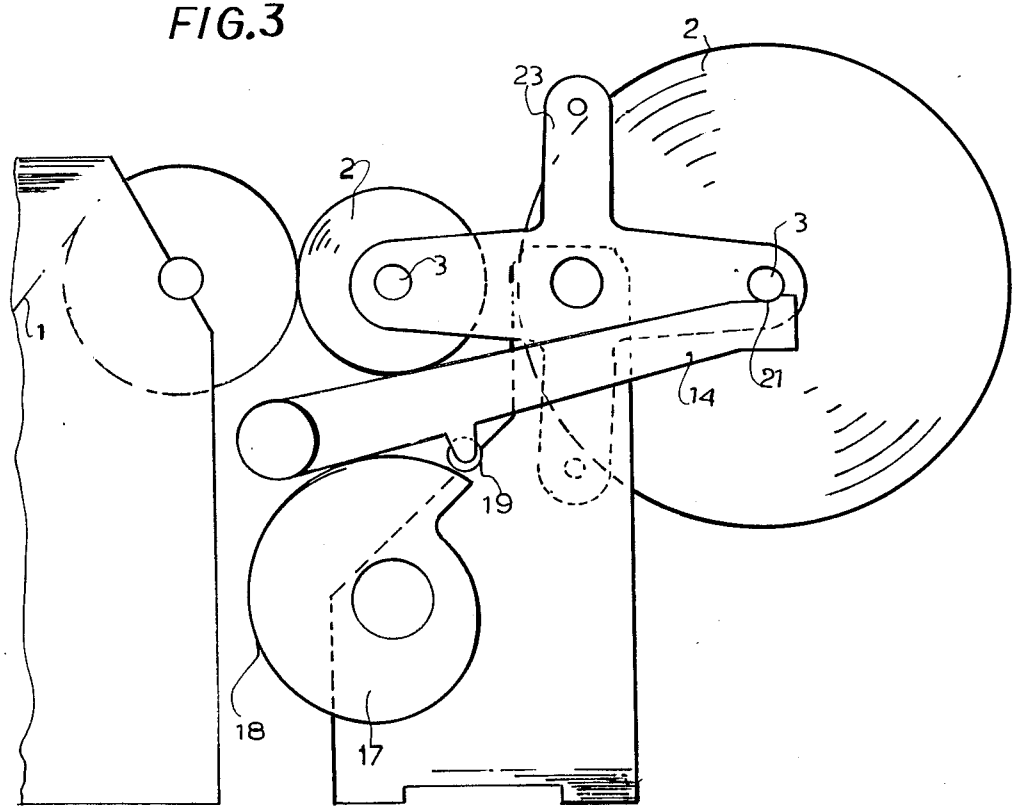

In the embodiment of FIG. 1, horizontally running support guide rails 10, pertaining to corresponding lateral walls 11, are provided along the swivel path of the swivel arms 4. Ends of the roll core 3 are supported on the support guide rails 10. The swivel arms 4 provided with the roll core drive 8 work only as a contact-pressure producing device. They are equipped with corresponding actuating-cylinder pistons 7. In their receiving position for the roll core 3 with its finished foil roll 2, shown in solid lines in FIG. 1, the lowering arms 14 reach over the support guide rails 10 with their receiving claws 21. They can be actuated by means of limit switches 22, which are located in this area on the support guide rails 10 and/or the receiving claws 21. The embodiment according to FIG. 3 can be understood by reference to the preceding explanations and the thereto pretaining reference numerals. It is made clear that instead of the swivel arms 4 of the embodiment of FIG. 1, the arrangement can also work with a revolving star 23. To the right in FIG. 3 a ready foil roll 2 can be discerned and oppositely thereto, a foil roller 2, whereupon the foil web is going to be wound.

We claim:

1. A lowering mechanism for a foil roll in a device for winding up a foil web comprising:

a frame;

a contact roller mounted on said frame for guiding said foil web;

a roll core receiving said foil web guided from said contact roller, said foil web being wound around said roll core to form said foil roll;

a pair of loweing arms each for receiving an end of said roll core, said lowering arms each attached to one side of said frame;

a pair of lowering arm plates mounted each on a side of said frame having an outer leading edge basically in the shape of a numeral 6;

a guide means attached to each of said lowering arms to guide said arms through contact with said cam plates;

a drive shaft connecting said pair of lowering cam plates; and a drive means for rotating said drive shaft whereby as said cam plates are rotated by said drive means said lowering arms are moved between vertical positions for removing said foil roll.

2. Device according to claim 1 wherein the leading edges correspond to an equal-torque cam which maintains torque constant even when there is a change in angle of lowering of said foil roll.

3. Device according to claim 1 wherein the lowering cam plates are driven by said drive means which is a three-phase geared motor.

4. Device according to claim 1 wherein the lowering cam plates are set on a common drive shaft.

5. Device according to claim 1 wherein a horizontally running support guide rail is provided for supporting the ends of the roll core, and the lowering arms in their receiving position reach over the support guide rail with receiving claws and are set in operation via limit switches.

* * * * *